US007650669B2

(12) United States Patent
Bienek

(10) Patent No.: US 7,650,669 B2
(45) Date of Patent: Jan. 26, 2010

(54) DOOR CLOSER

(75) Inventor: Volker Bienek, Dortmund (DE)

(73) Assignee: Dorma GmbH + Co. KG, Ennepetal (DE)

( * ) Notice: Subject to any disclaimer, the term of this patent is extended or adjusted under 35 U.S.C. 154(b) by 424 days.

(21) Appl. No.: 11/793,258

(22) PCT Filed: Nov. 11, 2005

(86) PCT No.: PCT/EP2005/012090

§ 371 (c)(1),
(2), (4) Date: Jun. 18, 2007

(87) PCT Pub. No.: WO2006/066662

PCT Pub. Date: Jun. 29, 2006

(65) Prior Publication Data

US 2008/0076621 A1 Mar. 27, 2008

(30) Foreign Application Priority Data

Dec. 17, 2004 (DE) ..... 10 2004 061 627

(51) Int. Cl.
*E05F 1/00* (2006.01)
*E05F 1/08* (2006.01)
*E05F 3/00* (2006.01)

(52) U.S. Cl. ..... 16/71; 16/72; 16/49

(58) Field of Classification Search ..... 16/71, 16/78, 79, 80, 72, 73, 74, 75, 76, 77, 63, 16/49, 64, 65

See application file for complete search history.

(56) References Cited

U.S. PATENT DOCUMENTS 1,951,906 A 3/1934 Hansen (Continued)

FOREIGN PATENT DOCUMENTS

DE 32 02 966 8/1983

(Continued)

OTHER PUBLICATIONS

Search Report dated Feb. 16, 2006 for the co-pending International Application No. PCT/EP2005/012091.

(Continued)

*Primary Examiner*—Victor Batson
*Assistant Examiner*—Jeffrey O'Brien
(74) *Attorney, Agent, or Firm*—Cohen Pontani Lieberman & Pavane LLP

(57) ABSTRACT

A door closer includes a housing; an output shaft supported by the housing and rotatable in opposite door opening and closing directions; a cam disc disposed in the housing and mounted on the output shaft; a damping piston disposed in the housing; an opening piston disposed in the housing; first and second force transmission rollers; and two fixing bolts extending in the axial direction of the housing and transversely to the axis of the output shaft. The fixing bolts being disposed on two opposite sides of the output shaft, respectively. Each of the can disc and the first and second force transmission rollers has a circumferential recess or comprises two pieces, the fixing bolts being disposed in the recesses or between the respective two pieces so that each of the damping piston and the opening piston is prevented from rotating with respect to the cam disc.

9 Claims, 2 Drawing Sheets

U.S. PATENT DOCUMENTS

| | | | | |
|---|---|---|---|---|
| 3,369,323 | A | 2/1968 | Millard | |
| 4,376,323 | A | 3/1983 | Tillmann et al. | |
| 4,660,250 | A | 4/1987 | Tillman et al. | |
| 5,417,013 | A * | 5/1995 | Tillmann | 49/386 |
| 5,901,412 | A * | 5/1999 | Jentsch | 16/72 |
| 6,223,469 | B1 | 5/2001 | Moll | |
| 6,412,224 | B1 | 7/2002 | Feucht et al. | |
| 6,442,795 | B1 * | 9/2002 | Chen | 16/53 |
| 6,957,533 | B1 | 10/2005 | Olsson | |
| 2004/0182234 | A1 | 9/2004 | Busch | |
| 2006/0075684 | A1 | 4/2006 | Hansch et al. | |
| 2008/0127562 | A1 * | 6/2008 | Bienek | 49/334 |

FOREIGN PATENT DOCUMENTS

| | | | |
|---|---|---|---|
| DE | 40 38 720 | | 6/1992 |
| DE | 40 41 824 | | 6/1992 |
| DE | 295 21 068 | | 8/1996 |
| DE | 197 56 496 | | 7/1999 |
| DE | 10031403 | A1 * | 1/2002 |
| DE | 102 61 224 | | 5/2004 |
| EP | 492175 | A1 * | 7/1992 |
| EP | 1 092 829 | | 4/2001 |
| WO | WO 00/66864 | | 11/2000 |
| WO | WO 2004/106681 | | 12/2004 |

OTHER PUBLICATIONS

Search Report dated Feb. 10, 2006 for the co-pending International Application No. PCT/EP2005/012082.
Search Report dated Feb. 13, 2006 for the underlying International Application No. PCT/EP2005/012090.
Search Report dated Jan. 27, 2006 for the co-pending International Application No. PCT/EP2005/012165.
Search Report dated Feb. 24, 2006 for the co-pending International Application No. PCT/EP2005/012164.
Search Report dated Mar. 13, 2006 for the co-pending International Application No. PCT/EP2005/012166.

* cited by examiner

DOOR CLOSER

CROSS-REFERENCE TO RELATED APPLICATIONS

This is a U.S. national stage of International Application No. PCT/EP2005/012090, filed on 11 Nov. 2005. Priority is claimed on German Application No. 10 2004 061 627.2, filed on 17 Dec. 2004.

BACKGROUND OF THE INVENTION

1. Field of the Invention

The invention relates to a door closer, which has an output shaft, which can be actuated in the closing direction by an assembly of springs, and has a damping piston, which is in operable connection with the output shaft, as well as a pivotable actuating arm, which is coupled to the output shaft outside the housing, as well as a cam disc, which is connected to the output shaft inside the housing.

2. Description of the Related Art

A door closer of the species mentioned at the beginning is revealed in DE 40 41 824 C1, in which a rotation of the damping piston and of the opening piston about their longitudinal axes in relation to the cam disc is eliminated. Securing means, which prevent the rotation, are provided for this purpose. The proper functioning of the door closer is not at all affected by the incorporation of the securing means. The first choice of securing means are two rods, which, on the one hand, are firmly anchored in the spring support member and, on the other hand, can plunge, without any friction on the opposite side, into pocket bores of the damping piston. In this case, the securing rods extend horizontally to the axis of the closer shaft. The securing rods are disposed on either side close to the closer shaft in the axial direction of the housing. It is thus possible that, in the event of a rotation of the damping piston or of the spring support member, the securing rods either bear against the one or the other side of the closer shaft.

SUMMARY OF THE INVENTION

An object of the invention is to further develop the anti-rotation means of the state of the art in that a clearance-free contact is given at all times between the force transmission rollers and the damping piston or the opening piston. Furthermore, it is intended to improve the efficiency of the door closer.

This problem is solved with a door closer comprising a housing having an axial direction; an output shaft having an axis and supported by the housing, the output shaft being coupleable to a door via a pivotable actuating arm and being rotatable in a door opening direction and an opposite door closing direction; a cam disc disposed in the housing and mounted on the output shaft; a damping piston disposed in the housing; an opening piston disposed in the housing; a first force transmission roller; a second force transmission roller; and two fixing bolts extending in the axial direction of the housing and transversely to the axis of the output shaft and coupling the damping piston to the opening piston. The fixing bolts are disposed on two opposite sides of the output shaft, respectively. When the cam disc is charged by the opening piston via the second force transmission roller, the output shaft rotates in the door opening direction. When the cam disc is charged by the damping piston via the first force transmission roller, the output shaft rotates in the door closing direction. Each of the can disc and the first and second force transmission rollers has a circumferential recess or comprises two pieces, the fixing bolts being disposed in the recesses or between the respective two pieces so that each of the damping piston and the opening piston is prevented from rotating with respect to the cam disc.

The state of the art is improved in that, for the purpose of increasing the efficiency, the cam disc and the force transmission rollers respectively have a circumferential recess or a groove, which is dimensionally adapted such that fixing bolts of the known type can be supported therein with minor play. Embedding the fixing bolts on the one hand allows for a smaller structure of the door closer and moreover for a reliable mounting of such a door closer. For this purpose, the fixing bolts, which respectively have their ends threaded, are firmly screwed into the opening piston with one of their ends. Obviously, other connecting types are possible. For mounting the damping piston, the free ends of the screwed-in fixing bolts can plunge into the damping piston and can be secured therein by appropriate nuts, which are preferably provided in a stepped bore of the damping piston. In order to guarantee a precisely fixed position between the force transmission rollers and the cam disc, a spring element is placed between a bottom of the stepped bore and the nut. The spring element may be either a disc spring or any other suitable spring element. By means of such a spring element, the elasticity of the overall construction is increased, in particular during the rotation of the output shaft. Likewise, respective tolerances of the cam disc and of the force transmission rollers can be easily compensated for. However, a clearance-free contact is guaranteed at the same time between the force transmission rollers and the cam disc.

The circumferential groove in the rollers and the recess in the cam disc are preferably disposed in the area of the longitudinal axis of the cylinder bore. Such a disposition is able to transmit tension and compression forces without entailing any deformation of the fixing bolts. Thus, there is no height offset and therefore no bending moment will occur.

One the one hand, the clearance-free contact increases the operational safety and thus the efficiency and, on the other hand, such a door closer achieves a very good arresting function. Even in the event of reversals of the output shaft, the contact between the force transmission rollers and the cam disc is maintained permanently. For this purpose, the force transmission rollers are rotatably supported via bearing journals, which plunge into pocket bores provided within the opening piston and the damping piston. In order to prevent the bearing journals from sliding out of the pocket bores, they are protected from falling out by means of appropriate securing pins.

On account of the clearance-free contact, an optimal arresting function can be achieved of such a door closer while increasing the efficiency at the same time.

BRIEF DESCRIPTION OF THE DRAWINGS

Hereinafter, the invention will be explained based on one possible exemplary embodiment diagrammatically illustrated in the drawings, wherein.

DETAILED DESCRIPTION OF THE PREFERRED EMBODIMENTS

Figure 1:
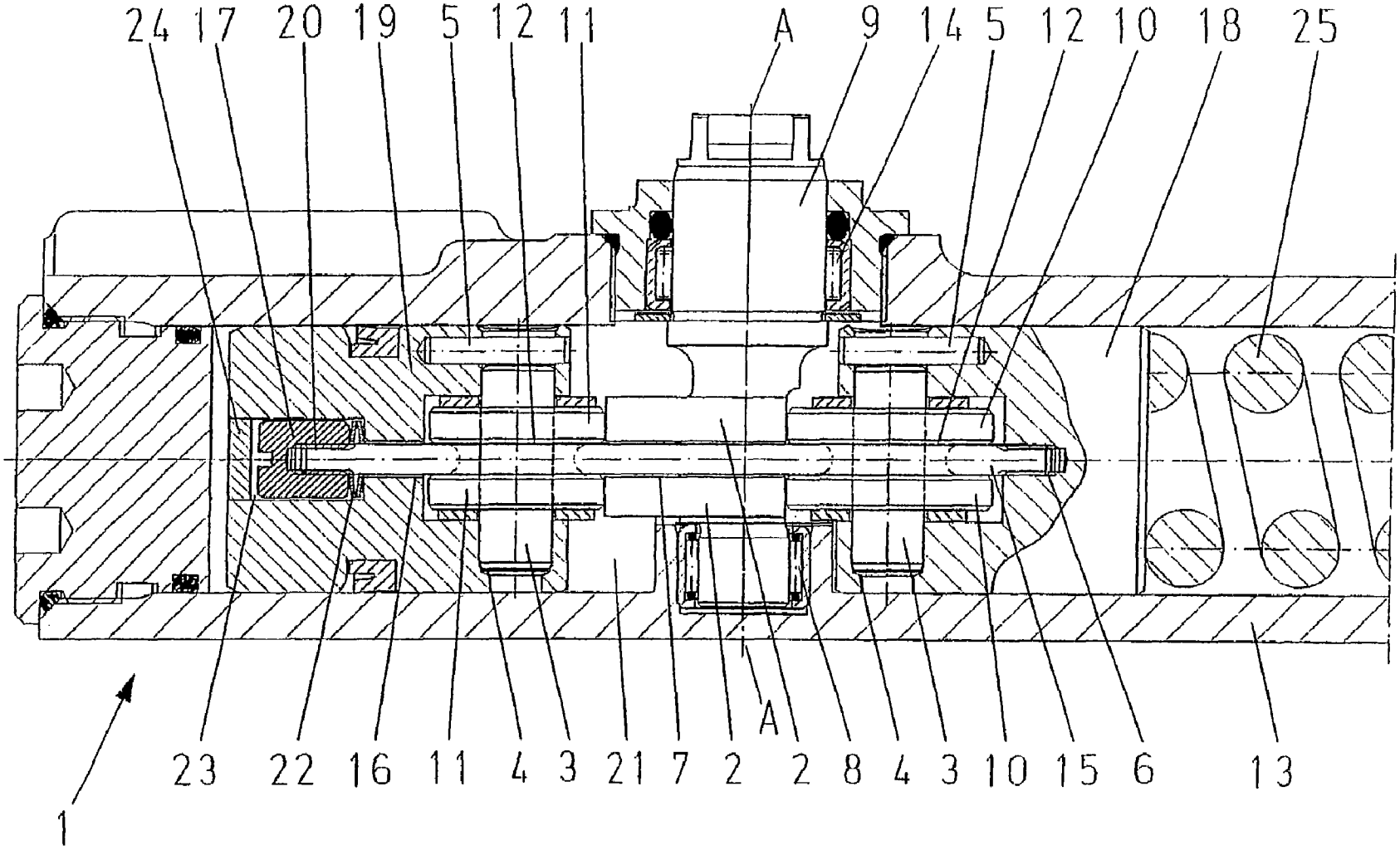
FIG. 1 shows a partial view of a door closer in a longitudinal cut according to the axis of the housing.

FIG. 1 shows a door closer indicated at 1 in a partial view, in which the components, which are not relevant for the invention, have been omitted or are not identified by a reference numeral. An output shaft 9 is supported in a bearing 8 within a housing 13 such that, at the exit side, the shaft 9 is connected to the housing 13 by means of a screwed cap with a bearing 14. The output shaft 9 has a longitudinal axis A-A and a cam disc 2, which has a circumferential groove 7 (see in particular FIG. 2).

A damping piston 19 and an opening piston 18 are displaceably supported within the closer housing 13 on the left and right sides of the cam disc 2. A spring 25, in the shape of a force accumulator, presses against the opening piston 18. Force transmission rollers 10 and 11 respectively are rotatably supported in both, the opening piston 18 and the damping piston 19 by means of bearing journals 3. In this case, the bearing journals 3 plunge into pocket bores 4. In order to prevent the bearing journals 3 from sliding out, they are secured by means of appropriate securing pins 5.

Within the force transmission rollers 10, 11 a circumferential groove 12 is respectively provided, like in the cam disc 2; it is also possible to execute the force transmission rollers 10, 11 and the cam disc in two pieces.

Referring to the opening piston 18, FIG. 1 represents a fixing bolt 15, which has threads 6 and 20 respectively at its ends. In this case, the thread 6 is screwed into a threaded bore in the opening piston 18. The dimensions of the fixing bolts 15 are adapted such as to be embedded with very little clearance within the groove of the force transmission rollers 10, 11 and within the groove 7 of the cam disc 2 as well.

The other end of the fixing bolts 15 with the thread 20 passes respectively through a bore 16 within the damping piston 19 and ends in a stepped bore 23 within the damping piston 19. A nut 17, which pulls the fixing bolt 15 on account of the thread 20 against a bottom of the stepped bore, is located in the stepped bore 23. In order to achieve a higher operational safety and tolerance compensation with regard to the force transmission rollers 10, 11 and the cam disc 9, a spring element 22, preferably in the shape of a disc spring, is introduced between the bottom of the stepped bore 23 and the nut 17. This achieves a permanent contact of the force transmission rollers 10, 11 and the cam disc 2.

In order to seal off this connection in the damping piston 19, the stepped bore 23 is closed by a seal washer 24.

Figure 2:
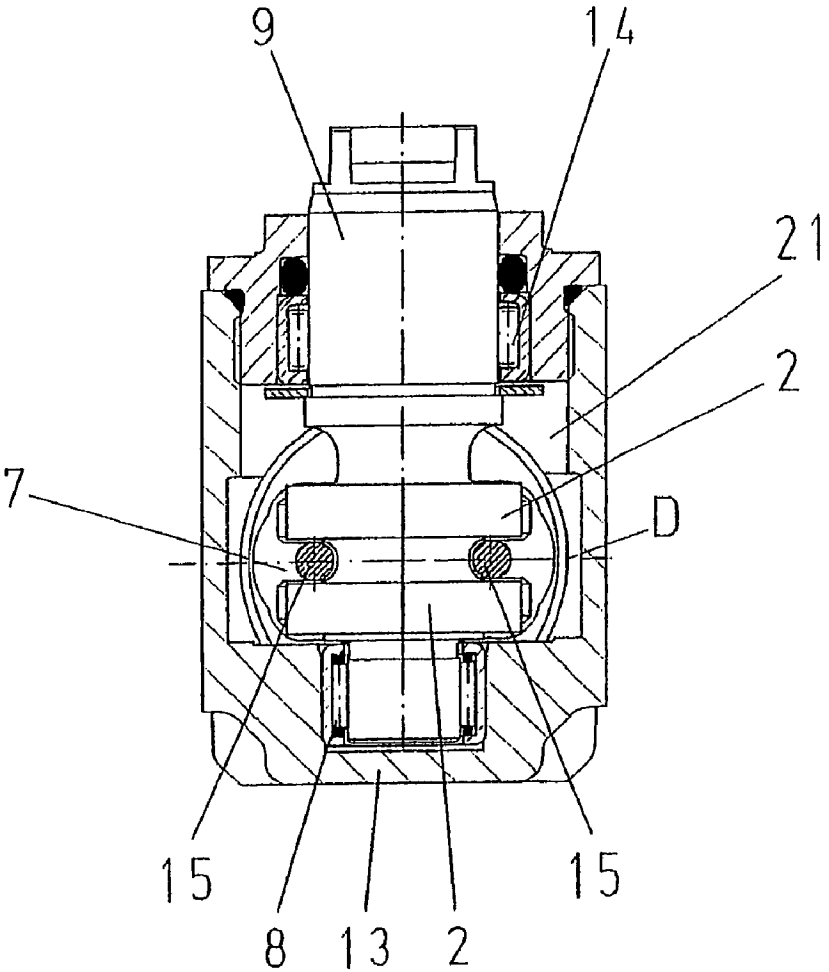
FIG. 2 shows the same as FIG. 1, however in a cross-section according to the line A-A through the output shaft.

FIG. 2 reveals that, on account of the stable position of the output shaft 9 through the internal bearings 8 and 14 and of the fixing bolts 15 embedded within the groove 7 of the cam disc 2, a rotation of the opening piston 18, displaceable within a reception compartment 21, and of the damping piston 19 about their own axes is not possible.

What is claimed is:

1. A door closer comprising: a housing having an axial direction; an output shaft supported by the housing, the output shaft being coupleable to a door via a pivotable actuating arm and being rotatable about an axis in a door opening direction and an opposite door closing direction;

a cam disc disposed in the housing and mounted on the output shaft; a damping piston disposed in the housing and having a first force transmission roller charged against a cam path associated with the closing direction for rotating the output shaft in the closing direction;

an opening piston disposed in the housing and having a second force transmission roller charged against a cam path associated with the opening direction for rotating the output shaft in the opening direction; and two fixing bolts extending in the axial direction of the housing and transversely to the axis of the output shaft and coupling the damping piston to the opening piston, the fixing bolts being disposed on two opposite sides of the output shaft, wherein each of the cam disc and the first and second force transmission rollers has a circumferential recess, the fixing bolts being disposed in the recesses so that each of the damping piston and the opening piston is prevented from rotating with respect to the cam disc.

2. The door closer of claim 1, wherein the housing defines a reception compartment for accommodating the opening piston and the damping piston, the reception compartment having a central axis, the fixing bolts extending parallel to the central axis.

3. The door closer of claim 1, wherein each fixing bolt has opposite first and second ends, each of the first and second ends being threaded ends.

4. The door closer of claim 3, wherein the opening piston has two threaded bores, the second threaded ends of the fixing bolts being threaded into the respective threaded bores of the opening piston.

5. The door closer of claim 4, further comprising two nuts which are disposed in the damping piston and threaded on the respective first threaded ends of the fixing bolts so that the damping piston together with the first force transmission roller is pulled against the cam disc, and the opening piston together with the second force transmission roller is pulled against the cam disc.

6. The door closer of claim 5, wherein the damping piston has two stepped bores, the nuts being embedded in the respective stepped bores of the damping piston.

7. The door closer of claim 6, further comprising two springs, each spring being respectively disposed between one of the nuts and a bottom of the respective stepped bore.

8. The door closer of claim 7, wherein each spring comprises a disc spring.

9. The door closer of claim 1, further comprising two securing pins and two bearing journals which are secured in the damping piston and the closing piston, respectively, by the securing pins, the first and second force transmission rollers being rotatably supported by the respective bearing journals.

* * * * *